US006753509B2

(12) United States Patent
Grätz et al.

(10) Patent No.: US 6,753,509 B2
(45) Date of Patent: Jun. 22, 2004

(54) COOKTOP WITH TEMPERATURE SENSOR

(75) Inventors: Franz Grätz, Traunwalchen (DE); Uwe Has, Unterneukirchen-Oberschroffen (DE); Dan Neumayer, Bernau (DE); Markus Theine, Freilassing (DE); Peter Vetterl, Grabenstätt (DE); Monika Zeraschi, Traunreut (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/223,036

(22) Filed: Aug. 16, 2002

(65) Prior Publication Data

US 2003/0029858 A1 Feb. 13, 2003

Related U.S. Application Data

(63) Continuation of application No. PCT/EP01/01385, filed on Feb. 8, 2001.

(30) Foreign Application Priority Data

Feb. 16, 2000 (DE) ..... 100 06 956

(51) Int. Cl.[7] ..... H05B 3/68

(52) U.S. Cl. ..... 219/448.17; 219/448.11; 219/460.1

(58) Field of Search ..... 219/446.1, 447.1, 219/448.11, 448.12, 448.14, 448.16, 448.18, 448.19, 458.1, 460.1; 136/221, 230, 231

(56) References Cited

U.S. PATENT DOCUMENTS 4,241,289 A * 12/1980 Bowling ..... 219/448.14
4,447,710 A 5/1984 McWilliams
4,851,645 A 7/1989 Wolf et al.
5,176,451 A * 1/1993 Sasada et al. ..... 374/179
5,877,475 A * 3/1999 Hecht et al. ..... 219/448.11
6,403,932 B1 6/2002 Nelson et al.

FOREIGN PATENT DOCUMENTS

| | | |
|---|---|---|
| DE | 27 47 652 A1 | 4/1979 |
| DE | 37 03 768 A1 | 8/1988 |
| EP | 0 021 107 A1 | 1/1981 |
| GB | 2 071 969 A1 | 9/1981 |

* cited by examiner

*Primary Examiner*—Sang Paik
(74) *Attorney, Agent, or Firm*—Laurence A. Greenberg; Werner H. Stemer; Ralph E. Locher

(57) ABSTRACT

In a cooktop with a cooktop plate, in particular, made from glass ceramic, beneath which at least one heating element is disposed, for heating a cooking vessel to be placed on the cooktop plate, and having a temperature sensor for recording the temperature of the cooktop plate, which temperature sensor senses the temperature of the underside of the cooktop plate within the heating element and is shielded from the thermal radiation from a heating device of the heating element by insulating material, and is connected to a control unit for controlling the heating power of the heating element, to enable a good measurement accuracy to be achieved, the temperature sensor is in thermal contact with the underside of the cooktop plate by a thermally conductive element, and that the element and the temperature sensor are shielded from the thermal radiation of the heating device by insulating material.

20 Claims, 3 Drawing Sheets

COOKTOP WITH TEMPERATURE SENSOR

CROSS-REFERENCE TO RELATED APPLICATION

This application is a continuation of copending International Application No. PCT/EP01/01385, filed Feb. 8, 2001, which designated the United States and was not published in English.

BACKGROUND OF THE INVENTION

Field of the Invention

The present invention relates to a cooktop or hob with a cooktop plate, in particular, made from glass ceramic, beneath which at least one heating element is disposed, for heating a cooking vessel that can be placed on the cooktop plate, and having a temperature sensor for recording the temperature of the cooktop plate, which temperature sensor senses the temperature of the underside of the cooktop plate within the heating element and is shielded from the thermal radiation from a heating device of the heating element by insulating material, and is connected to a control unit for controlling the heating power of the heating element, and to a corresponding heating element and a suitable element.

German Patent DE 37 03 768 C2, corresponding to U.S. Pat. No. 4,851,645 to Wolf et al., discloses a device for recording the temperature of a glass ceramic plate that is heated by heating windings or halogen lamps using a temperature sensor. The Wolf device emits a signal that corresponds to the temperature of the glass ceramic to a control circuit. The heating windings or the halogen lamps are disposed in the interior of a pot-like insulating support and heat the glass ceramic plate by direct radiation. The edge of the insulating support bears against the underside of the glass ceramic plate under spring stress, and the temperature sensor is disposed outside the interior of the insulating support but inside the heating element. Furthermore, the temperature sensor is connected in a thermally conductive manner to the underside of the glass ceramic plate, the temperature sensor being disposed in a recess in the edge of the insulating support. The recess is disposed at a distance x from the inner side of the edge of the insulating support, the minimum value for which distance is selected such that the brief temperature changes that occur when the heating windings or the halogen lamps are switched on or off have only a negligible influence on the temperature sensor. The maximum value for the distance x is selected such that the delay in the control characteristic that is caused by the thermal conduction of the glass ceramic plate results in a small hysteresis. Widths from 3 mm to 6 mm have proven to be advantageous values for the distance x. The temperature sensor is introduced into the formed or pressed-in recess on the upper side of the attachment that projects into the interior of the insulating support, and is connected in a thermally conductive manner to the underside of the glass ceramic plate. The temperature sensor is held indirectly through spring stress against the underside of the glass ceramic plate to keep the heat transfer resistance between the glass ceramic plate and the temperature sensor low.

Furthermore, European Patent Application EP 0 021 107 A1. discloses a heating element for a cooker unit having a temperature sensor. To maintain complete heating of the entire surface of the heating element while, nevertheless, closely coupling the temperature sensor of the controller to the heating, a heat transfer element in the form of a metal sheet is used, which is disposed between the heating bodies and the glass ceramic plate, partially covering the heated area, but projects out of the heating element, where it is connected to the temperature sensor of the controller. The heat-transfer element is fastened by secure clamping on the edge of the shell carrying the heating device and normally bears against the underside of the glass-ceramic panel. An outer section projects outward, beyond the edge of the heating element, from the area of the heat transfer element that senses the heat. The outer section is formed integrally with the above mentioned area, substantially parallel thereto, but offset downward to a slight extent by a bend, so that the outer section does not bear against the underside of the glass ceramic plate. The sensor cell of the temperature sensor is pressed by a compression spring onto the underside of the heat-transfer surface of the heat-transfer element, which is supported against a holding mechanism that guides the sensor cell and is disposed on the outer section of the heat-transfer element. However, other sensor types and configurations are also possible. For example, it is also possible to use an electrical NTC or PTC sensor that is pressed on resiliently or securely attached to the outer portion of the heat transfer element. If desired, the heat transfer element may be grounded so that electric shocks are prevented.

Furthermore, U.S. Pat. No. 4,447,710 to McWilliams discloses a glass ceramic cooktop in which an insulating body, on which a temperature sensor, for example, a thermocouple, is positioned, is disposed in the edge region of the heating element. The thermocouple is kept in good thermal contact with the underside of the glass ceramic plate by the insulating block.

SUMMARY OF THE INVENTION

It is accordingly an object of the invention to provide a cooktop with temperature sensor and a corresponding heating element that overcome the hereinafore-mentioned disadvantages of the heretofore-known devices of this general type and that have good measuring accuracy.

With the foregoing and other objects in view, there is provided, in accordance with the invention, a cooktop, including a glass ceramic cooktop panel having an underside, at least one heating element having a heating device for emitting thermal radiation, the heating element disposed beneath the cooktop panel for heating up a cooking vessel to be placed on the cooktop panel, a control unit electrically connected to the at least one heating element for controlling a heating power of the at least one heating element, a temperature sensor electrically connected to the control unit for controlling the heating power of the at least one heating element, a heat-conducting element holding the temperature sensor in heat-conducting contact at the underside of the cooktop panel within the at least one heating element, the temperature sensor sensing a temperature of the underside of the cooktop panel within the at least one heating element, and insulating material shielding the temperature sensor and the heat-conducting element from the thermal radiation. The insulating material can also substantially shield the temperature sensor and the heat-conducting element from the thermal radiation.

According to the invention, in the cooktop, the temperature sensor is in thermal contact with the underside of the cooktop plate by a thermally conductive element, and the element and the temperature sensor are shielded from the thermal radiation of the heating device by insulating material. Such a configuration ensures that the measuring configuration determines a temperature that, for example, corresponds to the temperature of a pan that has been placed on the cooktop plate above the heating element quickly and accurately enough. It is also ensured that the heat transfer from the pan or the cooktop plate to the temperature sensor is not limited to the very small area of the temperature sensor itself.

In accordance with another feature of the invention, the surface region A of the element that is in thermal contact with the underside of the cooktop plate is approximately at least 5 times, in particular, approximately 10 times larger than the base area B of the temperature sensor.

In accordance with a further feature of the invention, a lateral distance a between the element and the edge region of the insulating material is advantageously approximately 6 to 12 mm, in particular, approximately 8 mm. This value has surprisingly emerged if, on one hand, the shielding with respect to the thermal radiation from the heating device of the heating element is to be sufficiently great and if, on the other hand, the coupling of the thermally conductive element to the cooktop plate heated by the thermal radiation is to be sufficiently good.

In accordance with an added feature of the invention, to make it possible to provide ratios that are constant and defined by metrology over the operating life of the heating element, the temperature sensor is secured to the element, in particular, is secured to the element by being cast into the element.

To enable the element to be mounted quickly and without problems, the thermally conductive element is secured, in particular, by screw connection, in the region of the outer peripheral wall of the heating element or the insulating support, directly or with the aid of an intermediate mounting part. In particular, it is possible for the intermediate mounting part to be secured in the base region of the heating element and to extend into the region of the outer peripheral wall of the heating element in which the element is, in turn, screwed to the intermediate mounting part. To allow the pressure and the pressing area of the element, and, therefore, inter alia, the thermal coupling of the element to the underside of the cooktop plate, to be set correctly, it is possible for the element to be screwed to the outer peripheral wall of the heating element at different heights.

In accordance with an additional feature of the invention, the temperature sensor is secured to the underside of the element. On one hand, the configuration allows a large, flat bearing surface to be achieved to improve the conduction of heat from the underside of the glass ceramic plate to the temperature sensor. On the other hand, the temperature sensor is provided with better mechanical protection by the larger-area element during the mounting process, for example, when the element/temperature sensor unit is dropped.

To simplify mounting, the element may have a receiving section for the temperature sensor and a mounting section for securing the element, in particular, in the heating element, the receiving section lying laterally offset in the radial direction with respect to the mounting section. Such a configuration is important, in particular, if the temperature sensor is to be mounted in the immediate vicinity of a temperature limiter that is present at the heating element. This is because the temperature limiter restricts the mounting space in the region of the outer peripheral wall of the heating element, but, on the other hand, it is advantageous if the various electrical connections of the temperature limiter and the temperature sensor lie as close together as is permitted under safety regulations.

In accordance with yet another feature of the invention, the heat-conducting element has an underside, the temperature sensor is secured to the underside of the heat-conducting element, and the heat-conducting element is pressed onto the underside of the cooktop panel.

The element advantageously is in at least two-parts. In such a case, a receiving part for the temperature sensor is of a relatively soft material to allow the receiving part to be deformed with an optimum specific geometry in terms of its application and safety regulations. The remainder of the element may be of another material, with, in particular, a spring material being suitable to allow the element to be pressed in a defined manner onto the underside of the glass ceramic plate.

In terms of production and mounting technology, it is particularly favorable if the element is formed as a torsion spring, the torsion region of the spring element being provided substantially outside the heating element and, therefore, in a cooler region.

In accordance with yet a further feature of the invention, the heat-conducting element is a spring element and, limited to a region of the temperature sensor, pressed onto the underside of the cooktop panel.

In accordance with yet an added feature of the invention, the heat-conducting element has an upper wall and side walls and is approximately shroud-shaped at least in a region of the temperature sensor. The side walls of the heat-conducting element are skirt shaped.

In accordance with yet an additional feature of the invention, the heat-conducting element has a shroud with a bottom side and the shroud is at least partly closed on the bottom side.

According to a preferred embodiment, the element is configured to be electrically conductive and is grounded to optimally satisfy the safety regulations while having a simple structure.

To make mounting easier, and, in particular, for strain relief, the electrical lines of the temperature sensor are connected to a first connection section of the element or a connection piece mounted there. Accordingly, the element may also have a second connection section, to which a grounding line of the element is connected.

In accordance with again another feature of the invention, the heat-conducting element is a removable part of the at least one heating element.

With the objects of the invention in view, in a cooktop having a glass ceramic cooktop panel with an underside, at least one heating element having a heating device for emitting thermal radiation and disposed beneath the cooktop panel for heating up a cooking vessel to be placed on the cooktop panel, a control unit electrically connected to the at least one heating element for controlling a heating power of the at least one heating element, and a temperature sensor sensing a temperature of the underside of the cooktop panel within the at least one heating element, in heat-conducting contact with the underside of the cooktop panel within the at least one heating element, and electrically connected to the control unit, there is also provided a temperature sensor holder including a heat-conducting element holding the temperature sensor in heat-conducting contact at the underside of the cooktop panel within the at least one heating element and insulating material substantially shielding the temperature sensor and the heat-conducting element from the thermal radiation of the heating device.

With the objects of the invention in view, in a cooktop having a glass ceramic cooktop panel with an underside, a control unit, and a temperature sensor electrically connected to the control unit, there is also provided a heater including at least one heating element having a heating device for emitting thermal radiation, the at least one heating element electrically connected to the control unit for controlling a heating power of the at least one heating element and disposed beneath the cooktop panel for heating up a cooking vessel to be placed on the cooktop panel, a heat-conducting element holding the temperature sensor in heat-conducting contact at the underside of the cooktop panel within the at least one heating element to sense a temperature thereof, and insulating material substantially shielding the temperature sensor and the heat-conducting element from the thermal radiation of the heating device.

Other features that are considered as characteristic for the invention are set forth in the appended claims.

Although the invention is illustrated and described herein as embodied in a cooktop with temperature sensor, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
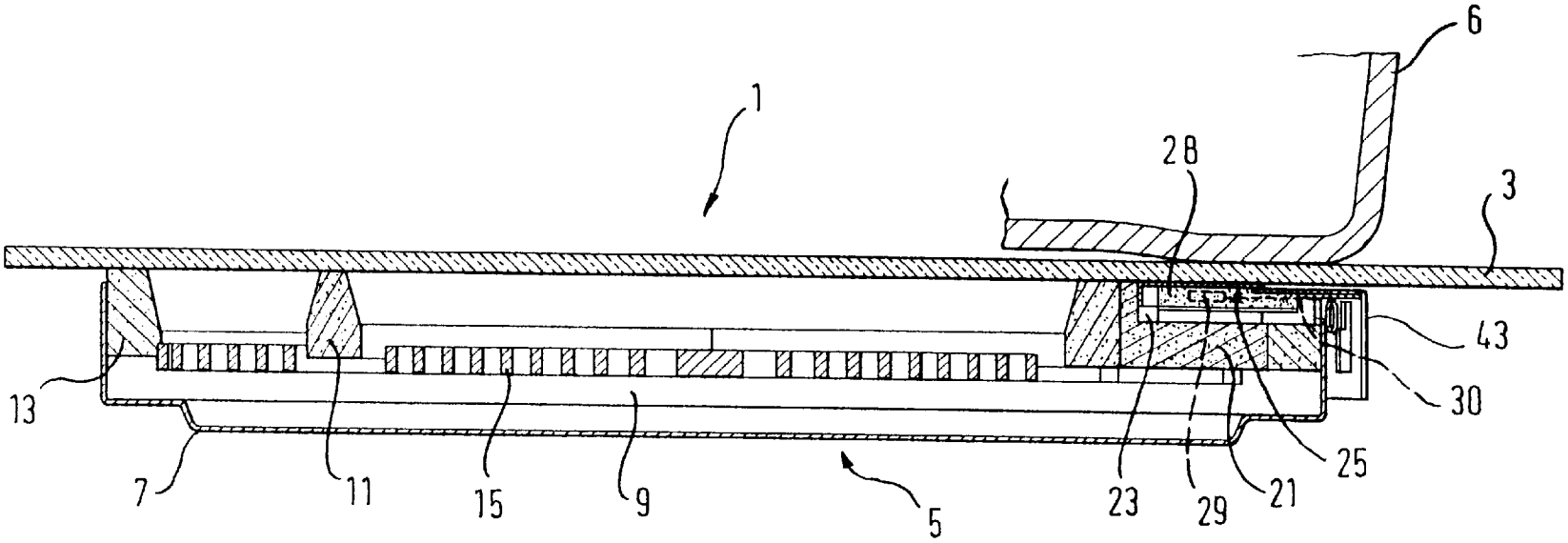
FIG. 1 is a fragmentary, cross-sectional view through line I—I in FIG. 2 of a cooktop with a heating element according to the invention.
Figure 2:
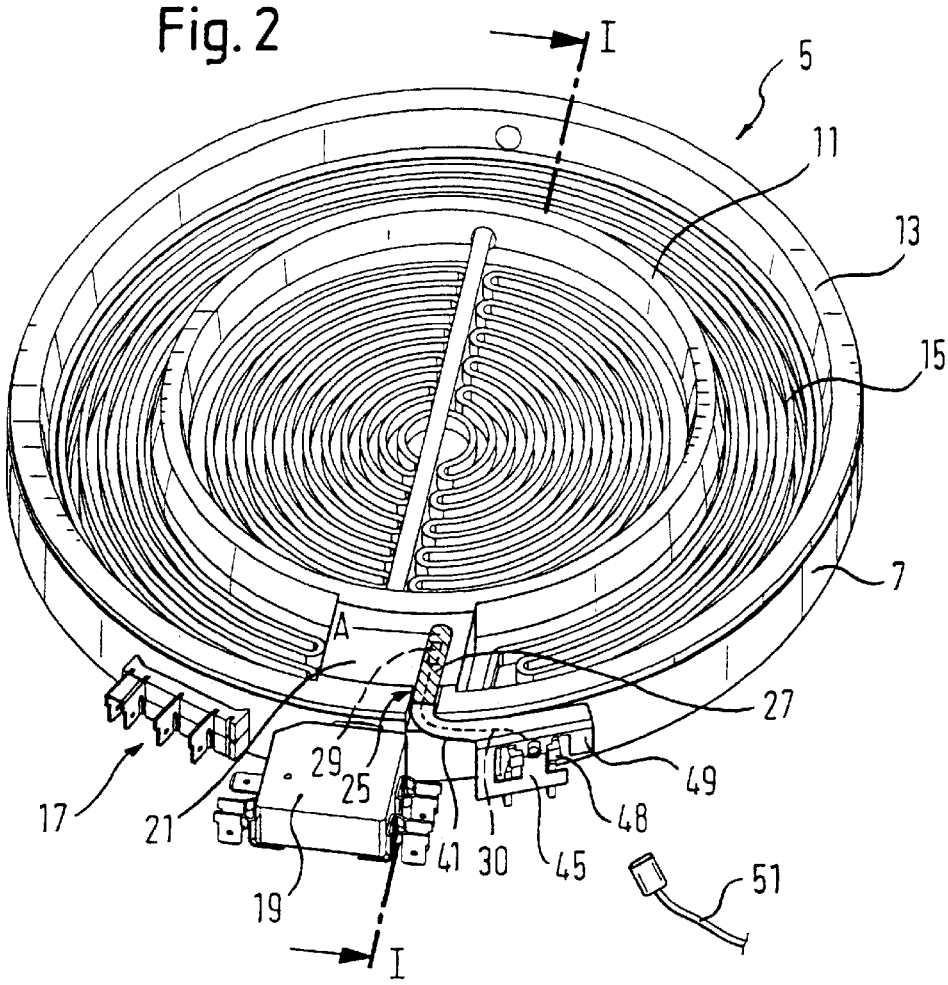
FIG. 2 is a partial fragmentary, perspective view from above of a heating element according to the invention.
Figure 3:
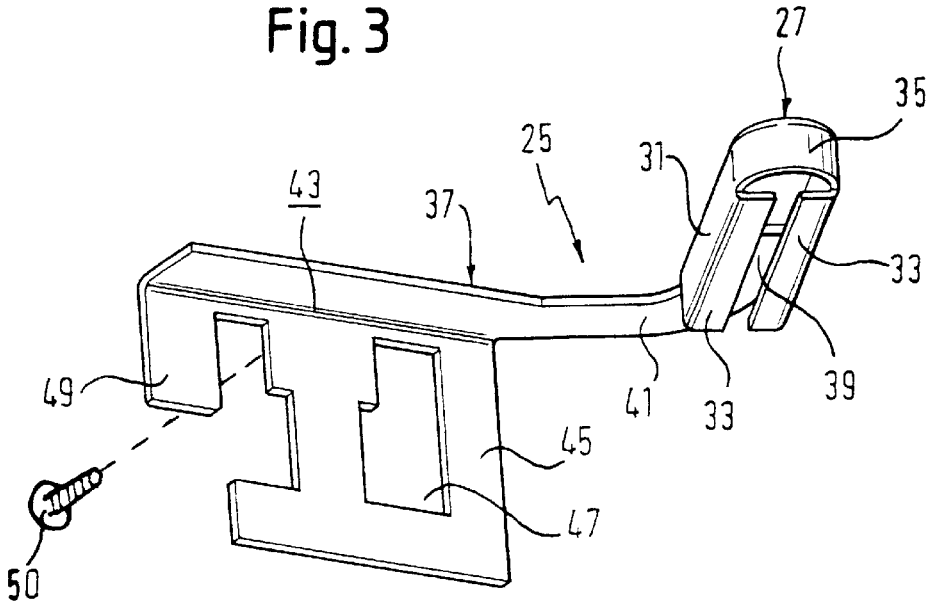
FIG. 3 is an enlarged, perspective view from below of a heat-conducting element from FIGS. 1 and 2 without a temperature sensor.

Referring now to the figures of the drawings in detail and first, particularly to FIG. 1 thereof, there is shown a cooktop 1 having a cooktop plate 3, in particular, made from glass ceramic (FIG. 1). In a conventional manner, various heating elements 5 of the cooktop, which are pressed in a conventional way onto the underside of the cooktop panel 3 (not shown), are provided in a conventional manner below the cooktop panel 3. In the region of the heating element 5, the cooktop panel 3 is usually decorated appropriately on its top side. A cooking vessel 6 can be put down in this heated region. In the cold state, the bottom of the cooking vessel 6 often rests on the cooktop plate 3 only in an annular area in the edge region of the heating element 5, while in the remaining central region the bottom of the pot is kept away from the plate by an air gap (see FIG. 1). In the heated state, this air gap is reduced or ideally becomes approximately zero as a result of the conventional thermally induced movement of the bottom of the pot. The heating element 5 has a dish-like sheet-metal cup 7, in which a circular disk-shaped insulating plate 9 lies. Furthermore, an inner insulating ring 11 and an outer insulating ring 13 are provided within the sheet-metal cup 7, on the insulating plate 9, corresponding to a two-circuit heating configuration. As a result, the interior of the heating element 5 is separated into an inner heating region and an outer heating region, in each of which a strip heating conductor 15 extends (FIGS. 1 and 2). In a conventional manner, a heating-conductor connection part 17, which, on one hand, is conductively connected to the strip heating conductors 15 and, on the other hand, can be connected to non-illustrated electrical supply lines of the cooktop 1 (FIG. 2), is secured in the region of the outer peripheral wall of the sheet-metal cup 7. The heating element 5 also has a conventional temperature limiter 19 and the bar of which extends transversely over the heated region of the heating element. The connection block of the temperature limiter 19 has the conventional and customary, laterally formed flat contact pins for connection to the voltage supply line or to the heating-conductor connection part 17 of the heating element 5. An insulating block 21 is disposed between the inner insulating ring and the outer insulating ring 13 in the region of the temperature limiter 19. The insulating block 21 can be used to thermally shield the temperature limiter 19 from sections of the strip heating conductor 15 that are guided below the insulating block 21 in the region of these sections. A receiving depression or recess 23 has been milled into the upper side of the edge region of the insulating block 21. A thermally conductive element 25 is disposed with its element shroud 27 in the recess 23 (FIGS. 1, 2, and 3). In this context, it should be ensured that the shroud 27 does not rest directly on the base of the recess 23 so that the shroud 27 can yield slightly in the event of an impact on the cooktop plate 3. The yielding makes it possible to avoid damage to or breakage of the plate 3, in particular, if it is made from glass or glass ceramic material.

Figure 5:
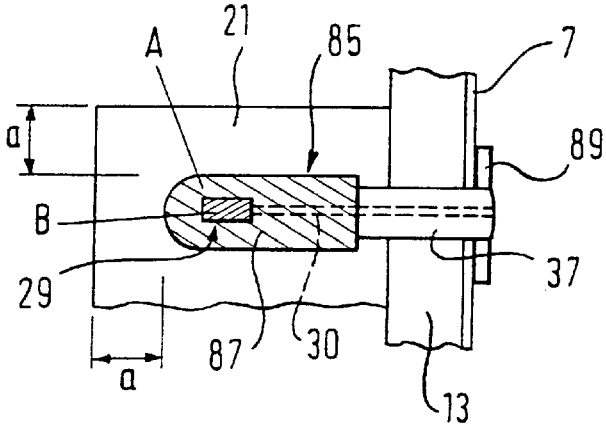
FIG. 5 is a simplified, fragmentary, cross-sectional view of a portion of a third embodiment of the heating element of FIGS. 1 and 2.

A PT-500 measuring sensor 29 is embedded with its sensor lines 30 in the receiving space formed by the element shroud 27, by a temperature-resistant and heat-conducting ceramic adhesive 28, and is fastened and guided in this way. The material of the element shroud 27 is X7 steel, and the shroud 27 is configured as a bending part with respect thereto. The shroud material must have sufficiently good thermal conduction properties and must be readily deformable, as explained below, but must be sufficiently mechanically stable over the entire temperature range of up to 350–400° C., and must also retain its properties even at such temperatures. Two side walls 31 are bent off downward substantially at right angles from the section of the element shroud 27 that serves as the upper wall (FIG. 3). Likewise bent off at right angles with respect to the side walls 31, bottom walls 33 delimit a base of the element shroud 27 that is open in the manner of a slot. On the end side, an end wall 35 that is bent off at right angles from the upper wall closes off the receiving space of the shroud. The shroud-like construction of the element 25 ensures that the clearance and leakage distance from the live temperature sensor 29 that are laid down by safety regulations are maintained in the event of the cooktop plate 3 breaking, without the base area of the element 25 or of the shroud 27 and, therefore, of the insulating block 21 having to be made excessively large. More precise explanations concerning the geometric construction and configuration of the temperature sensor 29, the element 25, and the insulating block 21 are given in connection with the description of the third exemplary embodiment, which is sketched in FIG. 5. The shroud 27 is fixedly connected, preferably, by welding, to a steel shroud support 37 that is of a substantially L-shaped configuration. For this purpose, the element shroud 27 rests on a connecting section 39 of the shroud support 37 (FIG. 3). As a result, the upper wall of the element shroud 27 is slightly elevated with respect to the upper side of the shroud support 37 and defines and delimits a surface area A in which the element 25 bears in a thermally conductive manner against the underside of the cooktop plate 3 (FIGS. 1, 2, 5). Moreover, the overlapping connection of shroud 27 and shroud support 37 increases the stability of the connection. While the shroud support 37 is of a material with a thickness of 0.8 mm, to be able to conform to the regulations for the grounding plug connections described below, the element shroud 27 is of a thinner material, which additionally makes it easier to deform.

The shroud support 37 merges in a resilient portion or spring section 41 into a fitting portion or mounting section 43 (FIGS. 2 and 3). In such a case, the spring section 41 is disposed substantially outside the heated region of the heating element 5 or of the outer insulating ring 13. The mounting section 43 of the shroud support 37 has a mounting plate 45 that is bent off downward at right angles and has mounting openings 47. The mounting openings 47 enable the thermally conductive element 25 to be secured in a vertically adjustable manner, through an intermediate mounting part 48, to the outer peripheral wall of the sheet-metal cup 7 (FIG. 2). For such a purpose, the intermediate mounting part 48 is, on one hand, screwed into the base of the sheet-metal cup 7 on the underside thereof (not shown). The mounting part 48 extends approximately in an L shape from the base of the heating element to its side wall 7. Then, the thermally conductive element 25 is screwed to (see, i.e., screw 50 in FIG. 3) the intermediate mounting part 48 in the side wall region so that the height of the thermally conductive element 25 can be fixed in a defined manner. Such a configuration obviates the need for complex screw openings in the side wall of the sheet-metal cup 7 and allows the openings that are always already present in the base of the sheet-metal cup to be utilized. Alternatively, however, the thermally conductive element 25 may also be screwed to the outer wall of the sheet-metal cup 7 in the region of the mounting openings 47. Furthermore, in the mounting openings 47 it is possible to secure a non-illustrated connecting part to which, on one hand, the electrical sensor line, 30 of the temperature sensor 29 can be connected, for example, by being plugged on, and to which, on the other hand, electrical connecting lines of a control unit 101 (FIG. 6) of the cooktop 1 are connected. Such a configuration provides reliable strain relief for the sensor lines 30. Furthermore, the connection part is able to ensure that the electrical connections of the PT temperature sensor 29 are insulated with respect to ground or the grounded shroud support 37. The temperature sensor and the sensor lines 30 are covered on the upper side over their entire length by the thermally conductive element 25. For improved guidance of the lines 30, they may be adhesively bonded to the underside of the element 25 in the region of the shroud support 37 and/or held by guide elements formed on the support 37. Furthermore, the mounting plate 45 has a flat pin 49, on which a grounding line 51 or its standardized AMP plug of the cooktop can be fitted directly. As a result, the thermally conductive element 25 is connected to ground potential. In such a case, it must be ensured that the resistance of the element 25 lies at a value of 0.1 ohm or less to be able to withstand a continuous current load of at least 25 A. Furthermore, the thermally conductive element 25 must also not be made to rigid to allow it to yield suitably under mechanical loading or in the event of movement of the cooktop plate 3. Otherwise, excessively rigid contact between the element 25 or the element shroud 27 and the cooktop panel 3 would lead to the risk of the cooktop panel flaking off at the underside of the panel 3 or possibly even of it breaking. Furthermore, it should be noted that an improvement in the thermal induction from the underside of the cooktop plate 3 to the thermally conductive element 25 could be achieved if the intermediate spaces between the lugs formed on the underside of the glass ceramic panel are filled with a thermally conductive paste or a suitable adhesive.

Figure 4:
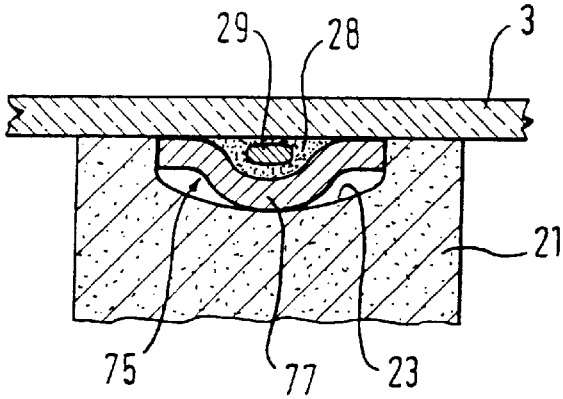
FIG. 4 is a simplified, fragmentary, cross-sectional view of a portion of a second embodiment of the heating element of FIGS. 1 and 2.

For reasons of simplicity, in the case of the cooktop or heating element in accordance with the second exemplary embodiment, wherever possible the same reference numerals are used as for the description of the first exemplary embodiment. FIG. 4 shows a partial sectional illustration, transversely with respect to the longitudinal extent of the element and, therefore, approximately perpendicular to line I—I in FIG. 2, of the region of the cooktop in which the temperature sensor 29 is disposed together with a thermally conductive element 75, in the region of the insulating block 21, in a similar manner to the first exemplary embodiment. Unlike in the first exemplary embodiment, the thermally conductive element 25 does not have an element shroud, but, rather, an element shell 77. The element shell is likewise disposed in a suitable receiving recess 23 in the insulating block 21. In its edge regions in an annular area, the insulating shell bears directly against the underside of the glass ceramic plate 3 and, as a result, is thermally conductively connected to it. The temperature sensor 29 is disposed in the element shell 77, the shell additionally being filled by a thermally conductive paste. The thermally conductive element 75, which is not shown in more detail, could, otherwise, be formed in the same way as the thermally conductive element 25 of the first exemplary embodiment. However, for safety reasons, the temperature sensor 29 is operated with a safety extra-low voltage or transmits its measuring signal from the heating element without contact.

According to the third exemplary embodiment, which is shown in FIG. 5, the thermally conductive element 85, which is configured, for example, in the form of a shroud, has an element shroud 87 that corresponds to that shown in the first exemplary embodiment. However, unlike in the first exemplary embodiment, a fitting portion or mounting section 89 of the shroud support 37 is not disposed radially offset in the lateral direction with respect to the receiving section of the element shroud 87. Rather, the mounting section 89 extends in line with the element shroud 87, without any radial offset, vertically downward along the outer wall of the sheet-metal cup 7. FIG. 5 diagrammatically depicts the surface area A in which the thermally conductive element 85 is in thermal contact with the underside of the cooktop plate 3. The size of the area is, in this case, approximately 50 to 100 $mm^2$. The figure also illustrates that the contact area A is approximately about 10 times larger than a base area B of the temperature sensor 29. The configuration ensures, inter alia, that the temperature at the underside of the cooktop plate is determined by the temperature sensor, not in a more or less punctiform manner, but, rather, in an integral manner over a relatively large surface area. This is important, in particular, because the respective pan diameter and the condition of its bottom are not precisely known and, in addition, may vary from type of pan to type of pan. A minimum lateral distance a from the element 85 to the edge region of the insulating material 21 is approximately 8 mm. Such placement provides an optimum geometry that has the following advantages for accurate control of the heating power or temperature, in particular, in the case of frying operations in pans 6 that have been placed on the cooktop plate 3. The temperature sensor 29 and the element shroud 27 are, on one hand, sufficiently shielded from the thermal radiation originating from the strip heating conductor 15 by the insulating block 21. On the other hand, the insulating block is still small enough to be able to avoid disadvantageous shadowing of the cooking vessel base 6 during heating or frying, with a resulting undesirably uneven heat distribution in the pan base. In particular, the thermally conductive element 25 is still sufficiently well thermally coupled to the area of the cooktop plate that is heated directly by the thermal radiation from the heating device 15. This is also achieved in the case of the first and third exemplary embodiments, the temperature sensor 29 at the same time being covered with respect to the cooktop plate 3 by a grounded protective element 27, taking account of the 4 mm clearance and 8 mm leakage distance laid down by regulations. Increasing the size of the area that is in thermal contact with the underside of the cooktop plate 3 also ensures that, despite all the assembly tolerances, sufficiently good thermal contact is produced between the temperature sensor, which has a relatively small area, and the cooktop plate 3. This is important, in particular, if a glass ceramic cooktop plate 3 with protuberances on the underside, the geometry of which protuberances is of the order of magnitude of the temperature sensor 29, is used. The above statements made in connection with the configuration of the geometries, distances, and size ratios apply to all three exemplary embodiments. If appropriate, the measuring area A is coupled by a high-temperature lubricant to the cooktop plate underside, which is, in particular, of glass ceramic material, to achieve improved heat transfer and improved damping under impact load.

Figure 6:
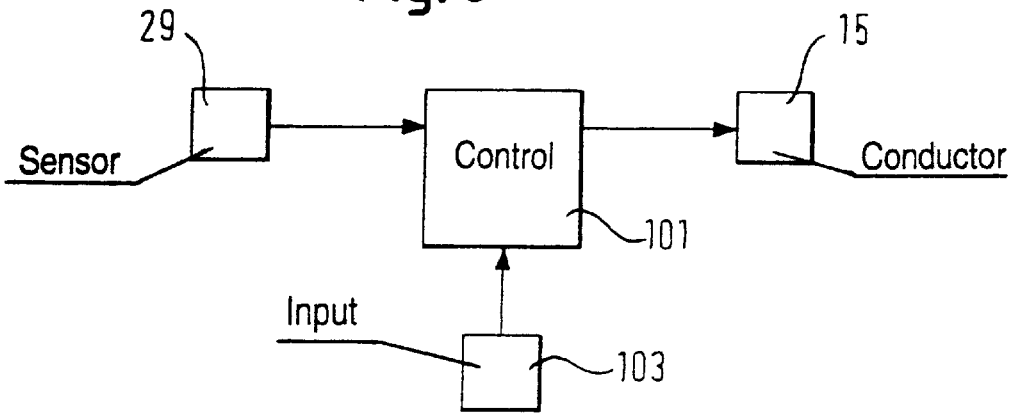
FIG. 6 is a block circuit diagram of the cooktop according to the invention.

A block diagram that shows the most important components of the cooktop is diagrammatically illustrated in FIG. 6. The control unit 101 controls the heating power of the strip heating conductor 15 in accordance with the measured values of the temperature sensor 29 to set the desired value that is predetermined by an input unit 103. The configuration, in particular, makes it possible to ensure that burning is virtually ruled out during frying.

We claim:

1. A cooktop, comprising:

a glass ceramic cooktop panel having an underside;

at least one heating element having a heating device for emitting thermal radiation, said heating element disposed beneath said cooktop panel for heating up a cooking vessel to be placed on said cooktop panel;

a control unit electrically connected to said at least one heating element for controlling a heating power of said at least one heating element;

a temperature sensor electrically connected to said control unit for controlling said heating power of said at least one heating element;

a heat-conducting element being a spring element pressed onto said underside of said cooktop panel at a region of said temperature sensor, and said heat-conducting element holding said temperature sensor in heat-conducting contact at said underside of said cooktop panel within said at least one heating element;

said temperature sensor sensing a temperature of said underside of said cooktop panel within said at least one heating element; and insulating material shielding said temperature sensor and said heat-conducting element from the thermal radiation.

2. The cooktop according to claim 1, wherein:

said heat-conducting element has an underside; and said temperature sensor is secured to said underside of said heat-conducting element.

3. The cooktop according to claim 1, wherein:

said temperature sensor has a base area;

said heat-conducting element has a surface region in thermal contact with said underside of said cooktop panel; and said surface region is at least approximately 5 times larger than said base area.

4. The cooktop according to claim 3, wherein said surface region is at least approximately 10 times larger than said base area.

5. The cooktop according to claim 1, wherein:

said at least one heating element has a temperature limiter; and said temperature sensor is disposed in a region of said temperature limiter.

6. The cooktop according to claim 1, wherein:

said at least one heating element has a temperature limiter; and said temperature sensor is disposed adjacent said temperature limiter.

7. The cooktop according to claim 1, wherein:

said heat-conducting element has an inside; and said temperature sensor is fastened to said inside of said heat-conducting element by casting.

8. The cooktop according to claim 1, wherein:

said heat-conducting element has an inside; and said temperature sensor is cast to said inside of said heat-conducting element.

9. The cooktop according to claim 1, wherein said heat-conducting element:

has an upper wall and side walls; and is approximately shroud-shaped at least in a region of said temperature sensor.

10. The cooktop according to claim 9, wherein:

said heat-conducting element has a shroud with a bottom side; and said shroud is at least partly closed on said bottom side.

11. The cooktop according to claim 1, wherein said side walls of said heat-conducting element are skirt shaped.

12. The cooktop according to claim 1, wherein said side walls of said heat-conducting element have a skirt shape.

13. A cooktop, comprising:

a glass ceramic cooktop panel having an underside;

at least one heating element having a heating device for emitting thermal radiation, said heating element disposed beneath said cooktop panel for heating up a cooking vessel to be placed on said cooktop panel;

a control unit electrically connected to said at least one heating element for controlling a heating power of said at least one heating element;

a temperature sensor electrically connected to said control unit for controlling said heating power of said at least one heating element;

a heat-conducting element holding said temperature sensor in heat-conducting contact at said underside of said cooktop panel within said at least one heating element;

said temperature sensor sensing a temperature of said underside of said cooktop panel within said at least one heating element;

insulating material having an edge region, said insulating material shielding said temperature sensor and said heat-conducting element from the thermal radiation; and a lateral spacing from said heat-conducting element to said edge region of said insulating material being between approximately 5 mm and 12 mm.

14. The cooktop according to claim 13, wherein a lateral spacing of said heat-conducting element with respect to said edge region of said insulating material is approximately 8 mm.

15. The cooktop according to claim 13, wherein said heat-conducting element is:

a spring element; and is pressed onto said underside of said cooktop panel at a region of said temperature sensor.

16. A cooktop, comprising:

a glass ceramic cooktop panel having an underside;

at least one heating element having a heating device for emitting thermal radiation, said heating element disposed beneath said cooktop panel for heating up a cooking vessel to be placed on said cooktop panel;

a control unit electrically connected to said at least one heating element for controlling a heating power of said at least one heating element;

a temperature sensor electrically connected to said control unit for controlling said heating power of said at least one heating element;

a heat-conducting element being a spring element pressed onto said underside of said cooktop panel and limited to a region of said temperature sensor, said heat-conducting element holding said temperature sensor in heat-conducting contact at said underside of said cooktop panel within said at least one heating element;

said temperature sensor sensing a temperature of said underside of said cooktop panel within said at least one heating element; and insulating material shielding said temperature sensor and said heat-conducting element from the thermal radiation.

17. A cooktop, comprising:

a glass ceramic cooktop panel having an underside;

at least one heating element having a heating device for emitting thermal radiation, said heating element disposed beneath said cooktop panel for heating up a cooking vessel to be placed on said cooktop panel;

a control unit electrically connected to said at least one heating element for controlling a heating power of said at least one heating element;

a temperature sensor electrically connected to said control unit for controlling said heating power of said at least one heating element;

a heat-conducting element being a spring element pressed onto said underside of said cooktop panel at a region of said temperature sensor, and said heat-conducting element holding said temperature sensor in heat-conducting contact at said underside of said cooktop panel within said at least one heating element;

said temperature sensor sensing a temperature of said underside of said cooktop panel within said at least one heating element; and insulating material substantially shielding said temperature sensor and said heat-conducting element from the thermal radiation.

18. In a cooktop having a glass ceramic cooktop panel with an underside, at least one heating element having a heating device for emitting thermal radiation and disposed beneath the cooktop panel for heating up a cooking vessel to be placed on the cooktop panel, a control unit electrically connected to the at least one heating element for controlling a heating power of the at least one heating element, and a temperature sensor sensing a temperature of the underside of the cooktop panel within the at least one heating element, in heat-conducting contact with the underside of the cooktop panel within the at least one heating element, and electrically connected to the control unit, a temperature sensor holder comprising:

a heat-conducting element being a spring element pressed onto the underside of the cooktop panel at a region of the temperature sensor, and said heat-conducting element holding the temperature sensor in heat-conducting contact at the underside of the cooktop panel within the at least one heating element; and insulating material substantially shielding the temperature sensor and said heat-conducting element from the thermal radiation of the heating device.

19. The temperature sensor holding according to claim 18, wherein said heat-conducting element is a removable part of the at least one heating element.

20. In a cooktop having a glass ceramic cooktop panel with an underside, a control unit, and a temperature sensor electrically connected to the control unit, a heater comprising:

at least one heating element having a heating device for emitting thermal radiation, said at least one heating element electrically connected to the control unit for controlling a heating power of said at least one heating element and disposed beneath the cooktop panel for heating up a cooking vessel to be placed on the cooktop panel;

a heat-conducting element being a spring element pressed onto the underside of the cooktop panel at a region of the temperature sensor, and said heat-conducting element holding the temperature sensor in heat-conducting contact at the underside of the cooktop panel within said at least one heating element to sense a temperature thereof; and insulating material substantially shielding the temperature sensor and said heat-conducting element from the thermal radiation of said heating device.

* * * * *